US005259774A

United States Patent [19]

Gabrius

[11] Patent Number: 5,259,774

[45] Date of Patent: Nov. 9, 1993

[54] TRACK AND INSULATOR CONSTRUCTIONS FOR TRACK LIGHTING SYSTEMS FOR BUS BAR SPACING

[75] Inventor: Algimantas Gabrius, Carol Stream, Ill.

[73] Assignee: Juno Lighting, Inc., Des Plaines, Ill.

[21] Appl. No.: 867,378

[22] Filed: Apr. 13, 1992

[51] Int. Cl.[5] ..... H01R 25/14

[52] U.S. Cl. ..... 439/110; 439/116

[58] Field of Search ..... 439/110, 114, 116–119, 439/207

[56] References Cited

U.S. PATENT DOCUMENTS

| | | | |
|---|---|---|---|
| 3,910,667 | 10/1975 | Heritage | 439/117 X |
| 4,029,378 | 6/1977 | Bolis | 439/116 X |
| 4,289,365 | 9/1981 | Rutgers | 439/116 |

*Primary Examiner*—Eugene F. Desmond
*Attorney, Agent, or Firm*—Anthony S. Zummer

[57] ABSTRACT

A channel-shaped insulator is received in a channel-shaped metal track. First and second conductive bus bars are mounted in holders within the insulator, which has wall portions disposed between the track and the bus bars and affording spacing therebetween. The track is formed with first and second longitudinal grooves opposite the bus bars and affording additional spacing between the track and the bus bars. First and second longitudinal ridges are formed on the insulator opposite the first and second bus bars and extending into the grooves for engaging the track to maintain the additional spacing. The depth of the grooves preferably corresponds with the thickness of the wall portions of the insulator between the track and the bus bars. The height of the ridges preferably corresponds with the depth of the grooves. The provision of the grooves and the ridges may increase the minimum spacing between the metal track and the bus bars from 1/32 of an inch to 1/16 of an inch. Additional ridges preferably project from the insulator adjacent the first and second ridges, but spaced laterally therefrom, to prevent shifting of the insulator and to assist in maintaining the additional spacing. Three bus bars may be mounted in holders within the insulator to afford two separate electrical circuits. At least three ridges, are formed on the insulator to project into grooves opposite the bus bars. A fourth ridge is formed on the insulator opposite one of the bus bars to project into the corresponding groove.

12 Claims, 2 Drawing Sheets

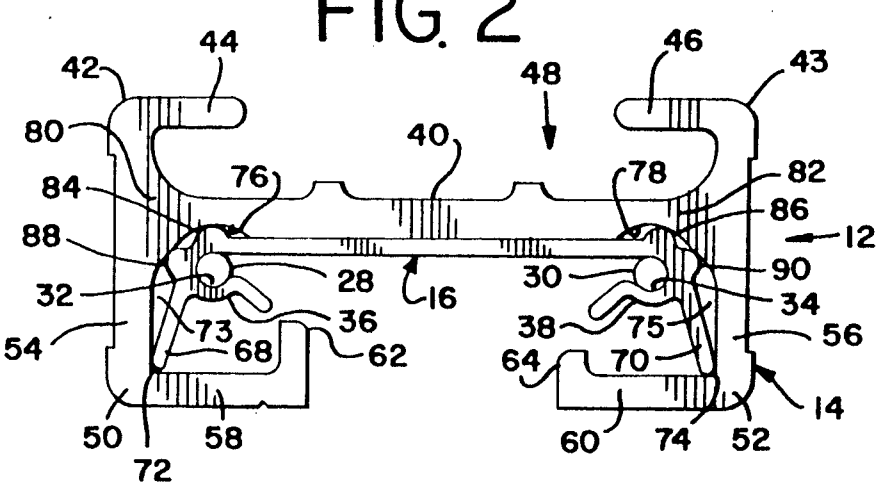
FIG. 1
FIG. 2
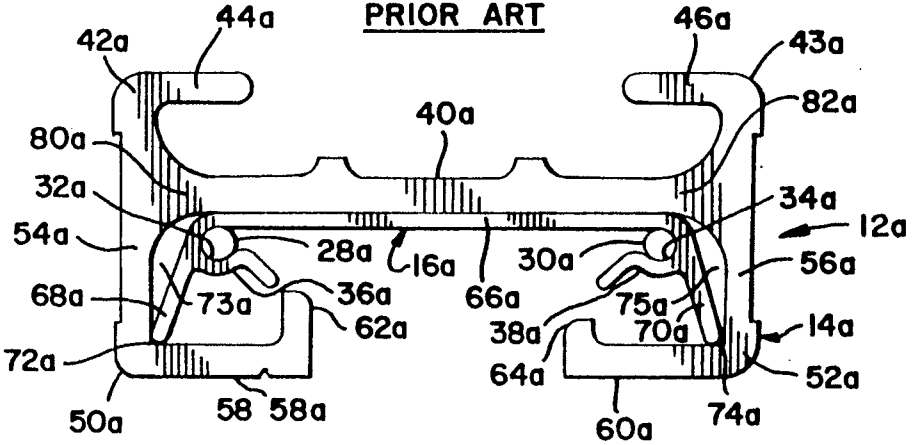
FIG. 3
PRIOR ART

TRACK AND INSULATOR CONSTRUCTIONS FOR TRACK LIGHTING SYSTEMS FOR BUS BAR SPACING

FIELD OF THE INVENTION

This invention relates to track lighting systems and pertains more specifically to improved track and insulator constructions for such systems.

BACKGROUND OF THE INVENTION

Track lighting systems are well known whereby a lighting fixture is slidable along a track adapted to be mounted on a ceiling or some other supporting surface. The track is generally channel-shaped and typically is in the form of an extrusion made of aluminum or some other suitable metal or metal alloy. One or more lighting fixtures may be slidable along the track so that the positioning of the lighting fixtures can be adjusted as desired. Electrical power is generally supplied to the adjustable lighting fixtures by at least two electrical conductors in the form of wires or bus bars supported by an insulator mounted in the track. Typically, the insulator is also channel-shaped and is securely mounted within the channel-shaped track. The insulator is generally made of a polymeric resinous plastic material.

Each of the lighting fixtures typically includes an adapter which is slidable along the track. A supporting member extends downwardly from the adapter for supporting a lamp housing which contains a lamp socket for receiving a lamp. The adapter typically includes a pair of electrically conductive contacts which are slidable along the bus bars and are connected by means of wire leads to the lamp socket.

Underwriters Laboratories has established electrical safety standards which regulate, among other things, the minimum spacing between each of the electrical bus bars and the adjacent portions of the metal track. The purpose of the minimum spacing is to obviate or minimize the possibility that one of the bus bars may come into contact with the metal track. Any such contact may produce an electrical shock hazard, if the track is not grounded, or a short circuit hazard, if the track is grounded.

For a long time, the minimum spacing required by Underwriters Laboratories was 1/32 of an inch between any bus bar and the metal track, whether separated from the bus bar by air or insulating material. A great many track lighting systems have been manufactured and installed, utilizing this minimum spacing of 1/32 of an inch, which in many instances was established by interposing a corresponding thickness of the insulator between the bus bar and the track.

In recent times, Underwriters Laboratories has modified its electrical safety standards so as to increase the minimum spacing from 1/32 of an inch to 1/16 of an inch. The necessity of compliance with this increased thickness requirement has created a need for producing improved track and insulator constructions which achieve the increased spacing between each bus bar and the track, without changing the spacing between the bus bars and without significantly changing the external and internal dimensions of the mechanical components of the track, so that the improved track and insulator constructions will be completely compatible with the previous track and insulator constructions whereby all existing lighting fixtures can be mounted for sliding adjustment along the improved tracks and insulators, and whereby existing connectors and other accessories can be used with the improved track and insulator constructions, with full compatibility and without any need for modifying the accessories.

OBJECTS OF THE INVENTION

One object of the present invention is to provide new and improved track and insulator constructions which comply with the increased spacing requirements, while maintaining complete compatibility with prior track and insulator constructions, built in accordance with the previous, more lenient spacing requirement, whereby the new track and insulator constructions can be used with the prior track and insulator constructions and with all of the lighting fixtures, connectors and other accessories designed for use with the prior constructions.

A further object is to provide such new and improved track and insulator constructions which can be manufactured with very little if any increase in cost.

Another object is to provide such new and improved track and insulator constructions which maintain the same mechanical track configurations and dimensions as previously used, while also maintaining the same bus bar locations and the same spacing between the bus bars as in the prior constructions.

SUMMARY OF THE INVENTION

To achieve these objects, the present invention provides an electrically conductive channel-shaped track having a longitudinal groove or channel formation opposite each bus bar location whereby the spacing between the external surface of the bus bar and the opposite surface of the groove is equal to or more than the required minimum spacing. An elongated insulator is provided for secure reception in the track. The insulator comprises holder means for receiving and holding each bus bar, and one or more projection means, preferably in the form of longitudinal ridges projecting from the insulator and extending into each of the longitudinal grooves for engaging the surface of the track in the groove to insure that the minimum spacing is maintained.

Each track is preferably a metal extrusion, whereby the groove or grooves can be formed in the process of extruding the track. The formation of the grooves does not involve any additional cost, other than the initial cost of the new or modified extrusion die. The formation of the groove or grooves actually reduces the amount of material in the track, so that the cost of the material is reduced slightly.

The ridge or ridges are formed in one piece with the insulator, so that the formation of the ridges involves only the original cost of the new or modified die used to produce the insulator, plus a very small cost for the slight amount of additional material required to form the ridges on the insulator.

BRIEF DESCRIPTION OF THE DRAWINGS

Further objects, features and advantages of the present invention will appear from the following description. taken with the accompanying drawings, in which:

FIG. 1 is a perspective view of a track lighting system having a combination of track and insulator constructions to be described as an illustrative embodiment of the present invention.

FIG. 2 is an end view showing the assembled track and insulator of FIG. 1, along with a pair of wire conductors or bus bars, mounted in their holders on the insulator.

FIG. 3 is an end view, similar to FIG. 2 but showing a prior art construction.

DETAILED DESCRIPTION OF ILLUSTRATIVE EMBODIMENTS

Figure 4:
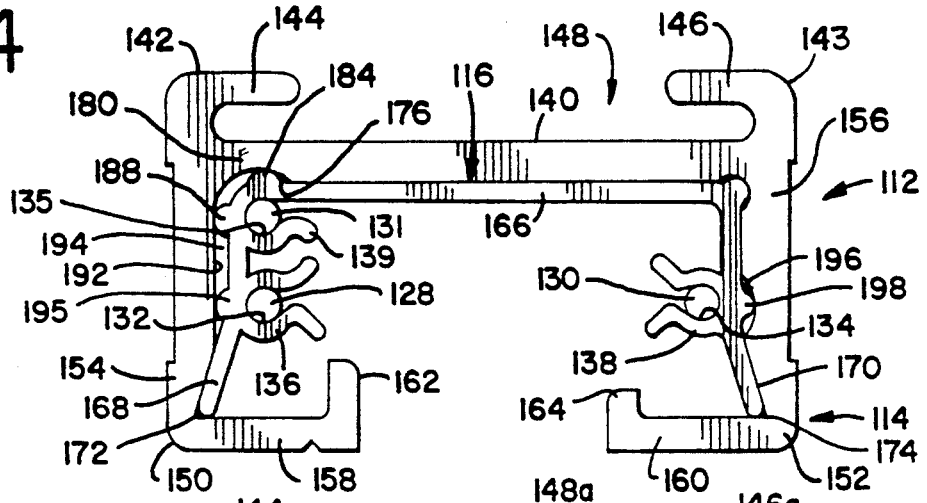
FIG. 4 is an end view of a second illustrative embodiment of the present invention, comprising a track and an insulator for holding three wire conductors or bus bars, whereby two electrical circuits are available for energizing the associated lighting fixtures.

As just indicated, FIG. 1 illustrates a track lighting system 10 having improved track means 12 to be described as an illustrative embodiment of the present invention. The improved track means 12 comprise an improved channel-shaped track 14 with an improved channel-shaped insulator 16 securely mounted therein. The track 14 is adapted to be mounted on or supported by the ceiling of a room, not shown. As shown in FIG. 1, the track 14 affords slidable support for a lighting fixture 18 which may be moved to any desired position along the length of the track 14. The track 14 is preferably made of extruded aluminum but may be made of any other metal or suitable material. The track 14 affords mechanical support for the lighting fixture 18 while also generally acting as an electrical grounding connector for the lighting fixture 18.

As shown in FIG. 1, the lighting fixture 18 comprises a slidable adapter 20 which is removably mounted on the track 14 and is slidably movable in a horizontal direction along the track. A supporting member in the form of a hollow arm or stem 22 extends downwardly from the adapter 20 and is connected at its lower end to a lamp housing 24 by means of a pivotal joint 26, having a horizontal pivot axis, so that the lamp housing 24 can be swingably adjusted in a vertical plane of movement. The lamp housing 24 generally contains a lamp socket for receiving a lamp, both not shown. Typically, the arm 22 and the lamp housing 24 are made of metal but may be made of other suitable materials.

In order to supply electrical power to the lamp in the lamp housing 24, the insulator 16 is adapted to support first and second electrical conductors or bus bars 28 and 30 which may take the form of cylindrical copper wires of a low resistance gauge, such as No. 12. As shown to best advantage in FIG. 2, the conductors or wires 28 and 30 snap into corresponding recesses 32 and 34 afforded by flexible resilient holders or clips 36 and 38 formed in one piece with the insulator 16. Preferably, the insulator 16 is in the form of an extrusion made of a suitable resinous plastic material which is a good electrical insulator and is mechanically strong.

Typically, the slidable adapter 20 is provided with a pair of spring contacts, not shown, which are connected to the lamp socket in the lamp housing 24 by wire leads, not shown, which extend through the hollow arm 22 to the lamp housing 24.

As shown in FIG. 2, the generally channel-shaped track 14 has a generally horizontal wall or web 40 adapted to be mounted on or connected to a ceiling, not shown. For that purpose, the opposite horizontal end of the wall 40 are formed with angle-shaped flanges 42 and 43, extending upwardly from the wall 40 and having opposed, substantially horizontal arms 44 and 46 extending toward each other and providing an inverted, generally T-shaped slot 48 adapted to receive a T-shaped bracket, hanger or the like, not shown, adapted to be secured to a ceiling.

To afford support for the adapter 20, the channel-shaped track 14 is provided with first and second generally J-shaped flanges 50 and 52, extending downwardly from the opposite ends of the horizontal wall 40. The illustrated J-shaped flanges 50 and 52 have downwardly extending legs 54 and 56 which carry first and second substantially horizontal arms 58 and 60, extending inwardly toward each other in an opposed relation. Rails 62 and 64 project upwardly from the inner ends of the respective arms 58 and 60, to afford slidable support for the adapter 20 of the lighting fixture 18. As shown, the first rail 62 is higher than the second rail 64, for cooperating with rider means, not shown, on the adapter 20 to insure that the adapter 20 will always be mounted on the rails with the correct mechanical and electrical polarity.

As shown in FIG. 2, the insulator 16 is generally in the form of an inverted channel which extends along the length of the channel-shaped track 14 and is securely received therein. The illustrated insulator 16 has a substantially horizontal upper wall or web 66 which engages the lower side of the horizontal wall 40 of the track 14. At the opposite ends of the horizontal wall 66, the insulator 16 is formed with legs or flanges 68 and 70 which extend downwardly and slant outwardly in opposite directions. The lower edge of the left hand leg 68 is closely received in an internal rectangular corner 72, formed between the generally vertical leg 54 and the generally horizontal arm 58 of the J-shaped flange 50. Similarly, the lower edge of the slanting leg 70 on the insulator 16 is closely received in an internal rectangular corner 74, formed between the vertical leg 56 and the horizontal arm 60 of the J-shaped flange 52. The insulator 16 can be slid longitudinally into the hollow channel-shaped track 14 but is held captive in a secure manner in the track 14 against any downward or lateral movement. As shown in FIG. 2, a tapered space 73 is provided between the leg 54 of the track 14 and the slanting leg 68 of the insulator 16. Similarly, a tapered space 75 is provided between the leg 56 of the track 14 and the slanting leg 70 of the insulator 16.

FIG. 3 illustrates a prior art track means 12*a* which has been extensively manufactured and sold by the applicant's assignee. The description thus far of the track means 12 of FIG. 2 is fully applicable to the prior art track means 12*a* of FIG. 3. In order to obviate any need for a duplicate description, the same reference characters have been applied to FIG. 3 as were applied to FIG. 2, but with the addition of the letter a, so that the description thus far herein can easily be read upon the track means 12*a*.

As shown in FIG. 3, the minimum spacing between each of the bus bars 28*a* and 30*a* and the channel-shaped track 14*a* is occupied by the horizontal wall 66*a* of the insulator 16*a*. Such minimum spacing is equal to or slightly greater than 1/32 of an inch, which is the thickness of the horizontal wall 66*a*. Thus, the track means 12a complies with the previous minimum spacing requirement of 1/32 of an inch, imposed by Underwriters Laboratories, but does not comply with the new minimum spacing 28a and 30a in the channel-shaped track 14a, as shown in FIG. 3, have been standardized by the applicant's assignee. Moreover, the spacing between the bus bars 28a and 30a has also been standardized. The construction, arrangement and dimensions of the adapter 20 on the lighting fixture 18 have likewise been standardized so as to fit properly within the track means 12a. Moreover, the construction of the connectors and other accessories for use with the track means 12a has also been standardized.

In accordance with the present invention, the construction of the new track means 12 has been modified so as to comply with the newly increased minimum spacing requirement, while maintaining full compatibility with the lighting fixture 18, and all other similar lighting fixtures, and also with the connectors and accessories already designed for use with the prior track means 12a.

To increase the spacing between the track 14 and the respective bus bars 28 and 30, the lower side of the horizontal wall 40 of the track 14 is formed with respective downwardly facing grooves or channels 76 and 78 which are opposite the respective bus bars 28 and 30 and are sufficiently deep to establish a minimum spacing which is equal to or greater than the new standard of 1/16 of an inch promulgated by Underwriters Laboratories. Thus, the groove 76 has a size and configuration which are such that the minimum spacing between the outer surface of the bus bar 28 and the adjacent portion 80 of the conductive wall 40 is equal to or greater than the required minimum spacing. Similarly, the size and configuration of the groove 78 are such that the minimum spacing between the outer surface of the bus bar 30 and the adjacent portion 82 of the wall 40 is equal to or greater than the required minimum spacing of 1/16 of an inch.

Projection means are formed on the insulator 16 to prevent any possible shifting of the insulator into the grooves 76 and 78. Such projection means also prevent any shifting of the bus bars 28 and 30 in such a manner as to bring either of them closer to the track 14 than the required minimum spacing. Such projection means comprise at least one longitudinal ridge 84 formed on the insulator 16 and extending into the groove 76, and at least one longitudinal ridge 86 on the insulator 16 and extending into the groove 78. The ridges 84 and 86 are sufficiently high to engage the adjacent portions 80 and 82, respectively, of the wall 40 of the track 14. As shown in FIG. 2, a second longitudinal ridge 88 is formed on the insulator 16 near the ridge 84 but spaced laterally therefrom for engaging a second location along the adjacent portion 80 of the wall 40. Similarly, a second longitudinal ridge 90 is preferably formed on the insulator 16 near the ridge 86, but spaced laterally therefrom, for engagement with a second location on the adjacent portion 82 of the wall 40 The ridges 84, 86, 88 and 90 preferably extend along the full length of the insulator 16.

As previously indicated, the track 14 is preferably formed as an aluminum or other metal extrusion. The grooves 76 and 78 are formed in the track 14 by providing and using a correspondingly shaped extrusion die. The only additional cost for providing the grooves 76 and 78 arises from the original cost of the extrusion die. The provision of the grooves 76 and 78 actually reduces the amount of material in the track 14 so that the cost of the track is correspondingly reduced.

As previously indicated, the insulator 16 is preferably made by extruding a thermoplastic resinous material. The longitudinal ridges 84, 86, 88 and 90 are formed by providing and using an appropriately shaped extrusion die. The cost of providing the ridges 84, 86, 88 and 90 is small because the ridges involve only a small amount of additional material. Moreover, the initial cost of the extruding die is spread over a great many pieces of the insulator 16.

FIG. 4 illustrates a second illustrative embodiment of the present invention, in the form of modified track means 112 comprising a modified channel-shaped track 114 in which a modified channel-shaped insulator 116 is mounted. Both the track 114 and the insulator 116 are quite similar to the track 14 and the insulator 16, already described in connection with FIGS. 1 and 2. To avoid unnecessary duplicate description, the various components of the track 114 and the insulator 116 are identified in FIG. 4 by reference characters which are the same as the reference characters applied to the corresponding components in FIGS. 1 and 2, except that each of the reference characters applied to FIG. 4 has been increased by 100. Except as expressly described herein, the components of the track 114 and the insulator 116 are the same as previously described in connection with FIG. 2. The principal difference between the track means 112 of FIG. 4 and the track means 12 of FIG. 2 resides in the fact that first, second and third electrical conductors or bus bars 128, 130 and 131 are provided in the track means 112, so that two electrical circuits can be supplied separately with electrical power. The two separate lighting circuits can be provided with separate controls, such as switches, dimmers or the like, not shown. Some of the lighting fixtures 18 can be energized from the first circuit, while other lighting fixtures are energized from the second circuit. Typically, the first circuit is connected between the bus bars 128 and 130, while the second circuit is connected between the bus bars 131 and 130. As before, the bus bars 128, 130 and 131 preferably take the form of cylindrical copper wires of a low resistance gauge, such as No. 12. As shown in FIG. 4, the conductors or wires 128, 130 and 131 snap into corresponding recesses 132, 134 and 135 afforded by flexible resilient holders or clips 136, 138 and 139 formed in one piece with the insulator 116. The insulator 116 is preferably in the form of an extrusion made of a suitable resinous plastic material.

As previously indicated, the slidable adapter 20 of the lighting fixture 18 is provided with a pair of spring contacts, not shown, connected to the lamp socket in the lamp housing 24. One of the spring contacts is engageable with the bus bar 130, while the other spring contact is adjustably mounted on the adapter 20 so as to be engageable with either the bus bar 128 or the bus bar 131.

Many of the components of the channel-shaped track 114 are the same as previously described. Thus, the track 114 is illustrated as comprising a horizontal wall 140, angle-shaped flanges 142 and 143, horizontal arms 144 and 146, and a T-shaped slot 148, which are the same as the previously described elements 40, 42, 43, 44, 46 and 48, respectively, shown in FIG. 2.

As before, the channel-shaped track 114 is provided with first and second generally J-shaped flanges 150 and 152, extending downwardly from the opposite ends of the horizontal wall 140. The J-shaped flanges 150 and 52 have downwardly extending legs 154 and 156 which are longer than the previously described legs 54 and 56, to afford room in the track 114 for the third bus bar 131. The legs 154 and 156 carry first and second substantially horizontal arms 158 and 160, extending inwardly toward each other. Rails 162 and 164 project upwardly from the inner ends of the respective arms 158 and 160 to afford slidable support for the adapter 20 of the lighting fixture 18. As before, the first rail 162 is higher than the second rail 164, to insure that the adapter 20 will always be mounted on the rails with the correct polarity. The elements 158, 160, 162 and 164 of FIG. 4 are the same as the corresponding elements 58, 60, 62 and 64 of FIG. 2.

As shown in FIG. 4, the insulator 116 is generally in the form of an inverted channel which extends along the length of the channel-shaped track 114 and is securely received therein. The insulator 116 has a substantially horizontal upper wall or web 166 which engages the lower side of the horizontal wall 140 of the track 114. At the opposite ends of the horizontal wall 166, the insulator 116 is formed with legs 168 and 170 which extend downwardly and slant outwardly in opposite directions. The legs 168 and 170 of FIG. 4 are substantially longer than the corresponding legs 68 and 70 of FIG. 2.

The lower edge of the left hand leg 168 is closely received in an internal, substantially rectangular corner 172, formed between the generally vertical leg 154 and the generally horizontal arm 158 of the J-shaped flange 150. Similarly, the lower edge of the right-hand leg 170 on the insulator 116 is closely received in an internal, generally rectangular corner 174, formed between the vertical leg 156 and the horizontal arm 160 of the J-shaped flange 152 The insulator 116 can be slid longitudinally into the hollow channel-shaped track 114 but is held captive in a secure manner in the track 114 against any downward or lateral movement.

Figure 5:
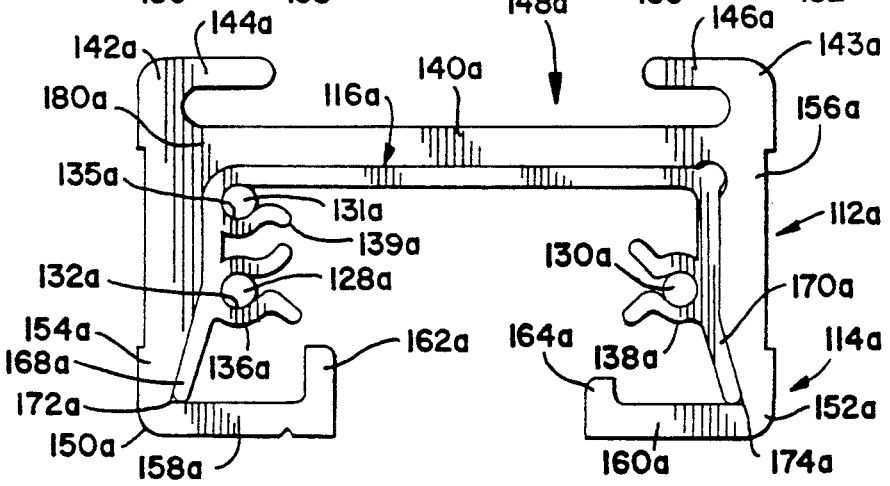
FIG. 5 PRIOR ART
FIG. 5 is an end view similar to FIG. 4, but showing a prior art construction.

FIG. 5 illustrates a prior art track means 112*a* which has been extensively manufactured and sold by the applicant's assignee. The description thus far of the track means 112 of FIG. 4 is fully applicable to the prior art track means 112*a* of FIG. 5. In order to obviate any need for a duplicate description, the same reference characters have been applied to FIG. 5 as were applied to FIG. 4, but with the addition of the letter "a", so that the description of the track means 112 can easily be read upon the track means 112*a*.

As shown in FIG. 5, the minimum spacing between the channel-shaped track 114*a* and each of the bus bars 128*a*, 130*a* and 131*a* is occupied by the various portions of the insulator 116*a*. Thus, the horizontal wall 166*a* of the insulator 116*a* is disposed between the bus bar 131*a* and the horizontal wall 140*a* of the track 114*a*. The downwardly extending leg or wall 168*a* of the insulator 116*a* is disposed between the generally vertical leg or wall 154*a* of the track 114*a* and the bus bars 128*a* and 131*a*. The depending leg or wall 170*a* of the insulator 116*a* is disposed between the bus bar 130*a* and the generally vertical leg or wall 156*a* of the track 114*a*. The thickness of the insulating walls or legs 166*a* , 168*a* and 170*a* is equal to or slightly greater than 1/32 of an inch, which complies with the previous minimum spacing requirement of 1/32 of an inch, imposed by Underwriters Laboratories, but does not comply with the new minimum spacing requirement of 1/16 of an inch.

The locations of the bus bars 128*a*, 130*a* and 131*a* in the channel-shaped track 114*a*, as shown in FIG. 5, have been standardized by the applicant's assignee. The construction, arrangement and dimensions of the adapter 20 on the lighting fixture 18 have likewise been standardized so as to fit properly within the track means 112*a*. Moreover, the construction of the connectors and other accessories for use with the track means 112*a* has also been standardized.

In accordance with the present invention, the construction of the new two-circuit track means 112 of FIG. 4 has been modified so as to comply with the newly increased minimum spacing requirement, while maintaining full compatibility with the lighting fixture 18 and all other similar lighting fixtures, and also with the connectors and accessories already designed for use with the prior track means 112*a*.

To increase the spacing between the track 114 and the bus bar 131, the lower side of the horizontal wall 140 of the track 114 is formed with a downwardly facing groove or channel 176 which is opposite the bus bar 131 and is sufficiently deep to establish a minimum spacing which is equal to or greater than the new standard of 1/16 of an inch, promulgated by Underwriters Laboratories. Thus, the groove 176 has a size and configuration which are such that the minimum spacing between the outer surface of the bus bar 131 and the adjacent portion 180 of the conductive wall 140 is equal to or greater than the required minimum spacing.

Projection means are formed on the insulator 116 to prevent any possible shifting of the insulator 116 into the groove 176. Such projection means also prevent any shifting of the bus bar 131 in such a manner as to bring the outer surface thereof closer to the track 114 than the required minimum spacing. As shown in FIG. 4, such projection means comprise at least one longitudinal ridge 184 formed on the insulator 116 and extending into the groove 176. The ridge 184 is sufficiently high to engage the adjacent portion 180 of the wall 140 of the track 114.

As shown in FIG. 4, a second longitudinal ridge 188 is formed on the insulator 116 near the ridge 184 but spaced laterally therefrom for engaging a recessed surface 192 formed in the upper portion of the vertical wall or leg 154 on the track 114 and constituting a continuation of the groove or channel 176. The provision of the recessed surface 192 forms a space or groove means 194 between the wall or leg 154 and the upper portion of the leg or wall 168 on the insulator 116. The second longitudinal ridge 188 prevents the insulator 116 from being moved into the space 194, so that the required minimum spacing is maintained between the bus bar 131 and the wall or leg 154. A third longitudinal ridge 195 is formed on the leg or wall 168 of the insulator 116, opposite the bus bar 128, to maintain the increased minimum spacing between the bus bar 128 and the leg or wall 168.

An additional longitudinal groove or channel 196 is formed in the vertical leg or wall 156 of the track 114, opposite the bus bar 130, so as to afford the increased minimum spacing between the bus bar 130 and the wall 156. The insulator 116 is provided with additional projection means in the form of an additional longitudinal ridge 198 which is formed on the leg or wall 170 of the insulator 116, opposite the bus bar 130, and adapted to extend into the longitudinal groove 196 and to engage the conductive wall 156 so as to prevent the leg 170 from being shifted into the groove 196, whereby the maintenance of the required minimum spacing is assured.

Very little, if any, additional cost is involved in extruding the track 114 so as to provide the groove 176, the recessed surface 192, and the additional groove 196. The cost is spread over a very large production of the extruded material for the track 114. Moreover, the formation of the elements 176, 192 and 196 actually reduces the amount of material in the track 114.

Similarly, the provision of the longitudinal ridges 184, 188 and 198 on the insulator 116 involves very little additional cost, for the reasons stated in connection with the insulator 16.

Figure 6:
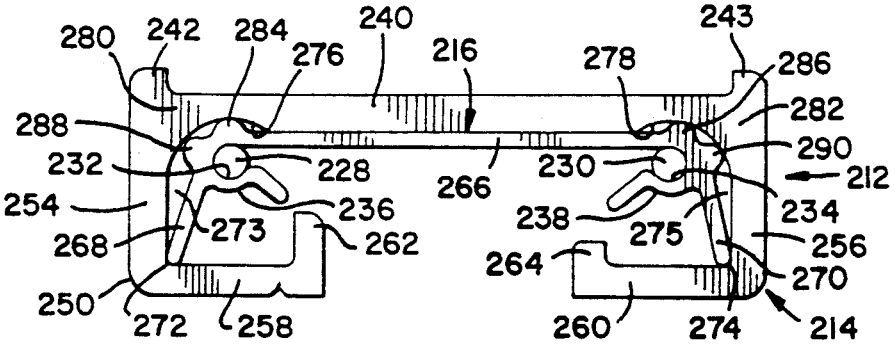
FIG. 6 is an end view of a third illustrative embodiment, similar to the embodiment of FIGS. 1 and 2, but utilizing a track having a smaller height and a modified cross-sectional shape.

FIG. 6 illustrates a modified illustrative embodiment of the present invention in the form of track means 212 including a metal track 214 which differs from the track 14 of FIG. 2 in that the angle-shaped flanges 42 and 43 are omitted and are replaced by low ridges 242 and 243, projecting upwardly a short distance above the track 214 at the opposite lateral sides thereof. Otherwise, the track means 212 and the track 214 are essentially the same as the track means 12 and the track 14, described in connection with FIG. 2. To avoid any necessity for duplicate description, the components of the track means 212 of FIG. 6 have been supplied with the same reference characters as were applied to the corresponding components of FIG. 2, except that each of the reference characters in FIG. 6 has been increased by 200. Except as expressly described herein, the track means 212, the track 214, the insulator 216 and the bus bars 228 and 230 are essentially the same as the track means 12, the track 14, the insulator 16 and the bus bars 28 and 30 of FIG. 2.

The track 214 of FIG. 6 is intended for flush mounting, in which the ridges 242 and 243 generally are engaged with a horizontal supporting surface. Suitable fasteners, not shown, are employed to secure the track 214 to the supporting surface.

Figure 7:
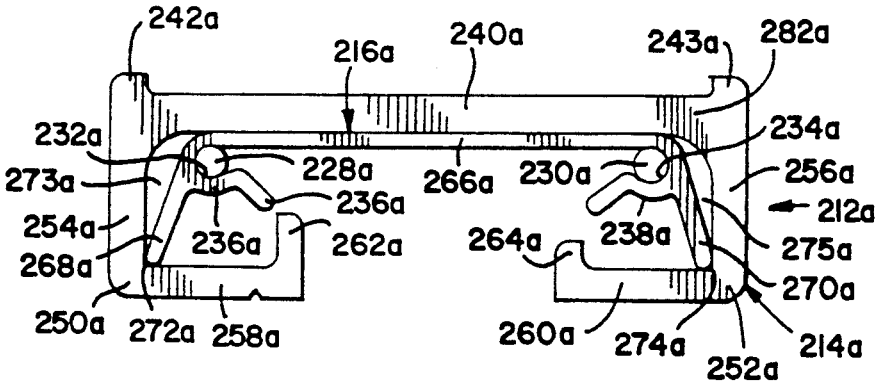
FIG. 7 PRIOR ART
FIG. 7 is an end view similar to FIG. 6 but showing a prior art construction.

FIG. 7 illustrates track means 212*a* including a track 214*a*, an insulator 216*a* and bus bars 228*a* and 230*a* which represent a prior art construction, previously manufactured and sold by the applicant's assignee. The track means 212*a*, the track 214*a*, the insulator 216*a* and the bus bars 228*a* and 230*a* are the same as the track means 12*a*, the track 14*a*, the insulator 16*a*, and the bus bars 28*a* and 30*a*, illustrated in FIG. 3 and previously described herein, except that the track 214*a* is modified by omitting the angle-shaped flanges 42*a* and 43*a* and replacing them with low ridges 242*a* and 243*a*, the same as the ridges 242 and 243 described in connection with FIG. 6. To avoid any need for a duplicate description, the same reference characters have been applied to the components illustrated in FIG. 7 as were applied to the corresponding components illustrated in FIG. 3, except that each of the reference characters in FIG. 7 has been increased by 200. Except as expressly described herein, the construction of FIG. 7 is essentially the same as the construction of FIG. 3.

As shown in FIG. 7, the minimum spacing between the channel-shaped track 214*a* and each of the bus bars 228*a* and 230*a* is occupied by the various portions of the insulator 216*a*. Thus, the horizontal wall 266*a* of the insulator 216*a* is disposed between the horizontal wall 240*a* of the track 214*a* and the outer cylindrical surfaces of the respective bus bars 228*a* and 230*a*. The thickness of the insulating wall 266*a* of the insulator 116*a* is equal to or slightly greater than 1/32 of an inch, which complies with the previous minimum spacing requirement imposed by Underwriters Laboratories, but does not comply with the new minimum spacing requirement of 1/16 of an inch.

In accordance with the present invention, the construction of the new track means 212 of FIG. 6 has been modified so as to comply with the newly increased minimum spacing requirement, while maintaining full compatibility with the lighting fixture 18 and all other similar lighting fixtures, and also with the connectors and accessories already designed for use with the prior track means 212*a*.

To increase the spacing between the track 214 and the respective bus bars 228 and 230, the lower side of the horizontal wall 240 of the track 214 is formed with respective downwardly facing grooves or channels 276 and 278 which are opposite the respective bus bars 228 and 230 and are sufficiently deep to establish a minimum spacing which is equal to or greater than the new standard of 1/16 of an inch.

Projection means are formed on the insulator 216 to prevent any possible shifting of the insulator 216 into the grooves 276 and 278. Such projection means also prevent any shifting of the bus bars 228 and 230 in such a manner as to bring either of them closer to the track 214 than the required minimum spacing. The projection means comprise at least one longitudinal ridge 284, formed on the insulator 216 and extending into the groove 276, and at least one longitudinal ridge 286, formed on the insulator 216 and extending into the groove 278. The ridges 284 and 286 are sufficiently high to engage the adjacent portions 280 and 282, respectively, of the wall 240 on the track 214.

As shown in FIG. 6, a second longitudinal ridge 288 in formed on the insulator 216 near the ridge 284, but spaced laterally therefrom, for engaging a second location along the adjacent portion 280 of the wall 240. Similarly, a second longitudinal ridge 290 is preferably formed on the insulator 216 near the ridge 286, but spaced laterally therefrom, for engagement with a second location on the adjacent portion 282 of the wall 240. The ridges 284, 286, 288 and 290 preferably extend along the full length of the insulator 216.

As shown in FIG. 6, a tapered space 273 is provided between the leg or wall 254 of the track 214 and the slanting leg or wall 268 of the insulator 216. Similarly, a tapered space 275 is provided between the leg or wall 256 of the track 214 and the slanting leg or wall 270 of the insulator 216. The ridges 288 and 290 on the insulator 216 are effective to prevent any possible shifting of the insulator 216 into either of the spaces 273 and 275, so that at least the required minimum spacing is maintained between the bus bar 228 and the leg or wall 254, and also between the bus bar 230 and the leg or wall 256.

Referring to FIGS. 2 and 3, the thickness of the horizontal walls 66 and 66*a* of the insulators 16 and 16*a* is equal to or slightly greater than the minimum spacing of 1/32 of an inch, previously required by Underwriters Laboratories. The same applies to the thickness of the slanting legs 68 and 70 of the insulator 16 and the slanting legs 68*a* and 70*a* of the insulator 16*a*.

The depth of the grooves or channels 76 and 78 corresponds generally with the thickness of the wall 66 of the insulator 16, so that the minimum spacing between each of the bus bars 28 and 30 and the wall 40 of the track 14 is at least doubled, so as to comply with the new minimum requirement of 1/16 of an inch. Typically, the depth of the grooves 76 and 78 is equal to or slightly greater than the thickness of the wall 66 of the insulator 16.

The height of the ridges 84 and 86 on the insulator 16 corresponds with the depth of the grooves 76 and 78, so that the ridges 84 and 86 will engage the adjacent portions 80 and 82 of the track 14, within the grooves. The height of the additional ridges 88 and 90 corresponds generally with the height of the ridges 84 and 86.

What has been said with respect to the thickness of the wall 66 and the legs 68 and 70 of FIG. 2 also applies to the wall 166 and the legs 68 and 170 of FIG. 4, and also to the wall 266 and the legs 268 and 270 of FIG. 6. Similarly, what has been said with respect to the depth of the grooves 76 and 78 of FIG. 2 also applies to the depth of the groove 176 of FIG. 4 and the depth of the grooves 276 and 278 of FIG. 6, as well as to the depth of the space 194 and the depth of the additional groove 196 of FIG. 4.

What has been said with respect to the height of the ridge 84, 86, 88 and 90 of FIG. 2 also applies to the ridges 184, 188, 195 and 198 of FIG. 4, and also to the ridges 284, 286, 288 and 290 of FIG. 6.

Various other modifications, alternative constructions and equivalents may be employed without departing from the true spirit and scope of the present invention, as disclosed in the drawings and the preceding description, and as defined in the following claims.

I claim:

1. Track means for a track lighting system, said track means comprising an elongated metal track which is generally channel-shaped in cross section and comprises a plurality of walls, an elongated generally channel-shaped insulator received and retained in said track, and at least first and second conductive bus bars mounted within said insulator, said insulator having holders for receiving and retaining said bus bars, said insulator having electrically insulating walls disposed between said track and said bus bars and affording spacing therebetween, said track having at least a first longitudinal groove therein opposite at least said first bus bar and affording additional spacing between said track and said first bus bar, said insulator having at least a first longitudinal ridge thereon opposite at least said first bus bar and extending into said groove for engaging said track to maintain the additional spacing, and an additional longitudinal ridge projecting laterally adjacent said first ridge but spaced laterally therefrom for engaging said track to prevent shifting of said insulator and said first bus bar.

2. Track means according to claim 1, in which said additional ridge has a height corresponding with the height of said first ridge.

3. Track means for a track lighting system, said track means comprising an elongated metal track which is generally channel-shaped in cross section and comprises a plurality of walls, an elongated generally channel-shaped insulator received and retained in said track, and at least first and second conductive bus bars mounted within said insulator, said insulator having holders for receiving and retaining said bus bars, said insulator having electrically insulating walls disposed between said track and said bus bars and affording spacing therebetween, said track having at least a first longitudinal groove therein opposite at least said first bus bar and affording additional spacing between said track and said first bus bar, said insulator having at least a first longitudinal ridge thereon opposite at least said first bus bar and extending into said groove for engaging said track to maintain the additional spacing, said track having a second longitudinal groove formed therein opposite said second bus bar and affording additional spacing between said track and said second bus bar, and a second longitudinal ridge formed on said insulator opposite said second bus bar and projecting into said second groove for maintaining the additional spacing, first and second additional ridges projecting from said insulator adjacent said first and second ridges but spaced laterally therefrom for engaging said track to prevent shifting of said insulator and said bus bars relative to said track.

4. Track means according to claim 3, in which each of said additional ridges has a height corresponding with the height of said first and second ridges.

5. Track means for a track lighting system, said track means comprising an elongated metal track which is generally channel-shaped in cross section and comprises a plurality of walls, an elongated generally channel-shaped insulator received and retained in said track, and at least first and second conductive bus bars mounted within said insulator, said insulator having holders for receiving and retaining said bus bars, said insulator having electrically insulating walls disposed between said track and said bus bars and affording spacing therebetween, said track having at least a first longitudinal groove therein opposite at least said first bus bar and affording additional spacing between said track and said first bus bar, said insulator having at least a first longitudinal ridge thereon opposite at least said first bus bar and extending into said groove for engaging said track to maintain the additional spacing, said track having a second longitudinal groove formed therein opposite said second bus bar and affording additional spacing between said track and said second bus bar, a second longitudinal ridge formed on said insulator opposite said second bus bar and projecting into said second groove for maintaining the additional spacing, said track has a generally horizontal wall and first and second generally vertical legs extending downwardly from opposite end portions of said horizontal wall, said insulator having a generally horizontal insulating wall engaging the underside of said horizontal wall of said track, said insulator having first and second legs slanting downwardly and outwardly from opposite end portions of said generally horizontal insulating wall, said track having flange means for supporting said legs, said slanting legs affording first and second spaces between said track and said respective first and second legs thereof, said insulator having at least first and second additional ridges extending therefrom adjacent said first and second ridges but spaced laterally therefrom to prevent lateral movement of said insulator into said spaces.

6. Track means according to claim 5, in which said insulator has a predetermined thickness of insulating material between said track and each of said bus bars, each of said grooves having a depth equal to or greater than said thickness, each of said first and second ridges and each of said first and second additional ridges having a height equal to or greater than said thickness for at least doubling the spacing between said track and each of said bus bars.

7. Track means for a track lighting system, said track means comprising an elongated metal track which is generally channel-shaped in cross section and comprises a plurality of walls, an elongated generally channel-shaped insulator received and retained in said track, and first, second and third conductive bus bars mounted in a spaced relation within said insulator, said insulator having holders for receiving and retaining said bus bars, said insulator having first, second and third wall portions disposed between said track and said respective first, second and third bus bars and affording spacing between said track and each of said bus bars, said wall portions having a predetermined thickness, said track having a plurality of groove means therein opposite said bus bars and affording additional spacing between said track and each of said bus bars, said insulator having at least first, second and third longitudinal ridges thereon opposite said respective first, second and third bus bars and extending into said groove means for engaging said track to maintain the additional spacing.

8. Track means according to claim 7, in which said insulator has an additional longitudinal ridge thereon opposite one of said bus bars and extending into one of said groove means for engaging said track.

9. Track means according to claim 7, said groove means comprising a first longitudinal groove means opposite said first bus bar, a second longitudinal groove means opposite said second bus bar, and a third longitudinal groove means opposite said third bus bar, said first and third groove means overlapping each other and constituting continuations of each other, said first longitudinal ridge projecting into said first groove means opposite said first bus bar, said second longitudinal ridge projecting into said second longitudinal groove means opposite said second bus bar, said third longitudinal ridge projecting into said third groove means opposite said third bus bar.

10. Track means according to claim 9, including an additional longitudinal ridge on said insulator opposite said third bus bar and extending into said third groove means for engaging said track, said additional longitudinal ridge being spaced laterally from said third longitudinal ridge.

11. Track means according to claim 7, in which said insulator has wall portions of predetermined thickness affording a corresponding spacing between said track and each of said bus bars, said groove means having a depth corresponding generally with said thickness, each of said ridges having a height corresponding generally with the depth of said groove means.

12. Track means for a track lighting system, said track means comprising an elongated metal track which is generally channel-shaped in cross section, an elongated generally channel-shaped insulator received and retained in said track, and at least first and second conductive bus bars mounted within said insulator, said insulator having holders for receiving and retaining said bus bars, said insulator having electrically insulating wall portions disposed between said track and said bus bars and affording spacing therebetween, said track having at least one longitudinal groove means therein opposite at least said first bus bar and affording additional spacing between said track and said first bus bar, said insulator having projection means thereon opposite at least said first bus bar and extending into said groove means for engaging said track to maintain the additional spacing, said track having a longitudinal groove means formed therein opposite said second bus bar and affording additional spacing between said track and said second bus bar, second projection means formed on said insulator opposite said second bus bar and projecting into said second groove means for maintaining the additional spacing, a third conductive bus bar mounted within said insulator, said insulator having an additional holder for receiving and retaining said third bus bar, said track having a third longitudinal groove means therein opposite said third bus bar and affording additional spacing between said track and said third bus bar, said insulator having third projection means thereon opposite said third bus bar and extending into said third groove means for engaging said track to maintain the additional spacing.

* * * * *

UNITED STATES PATENT AND TRADEMARK OFFICE

CERTIFICATE OF CORRECTION

PATENT NO. : 5,259,774

DATED : Nov. 9, 1993

INVENTOR(S) : Algimantas Gabrius

It is certified that error appears in the above-identified patent and that said Letters Patent is hereby corrected as shown below:

Column 5, Line 4, after "spacing" insert -- requirement of 1/16 of an inch. The locations of the bus bars--

Column 5, line 59, after "40" insert --.--

Column 7, line 35, after "152" insert --.--

Column 11, line 9, delete "68" substitute therefor --168--

Column 14, line 44, after "a" insert --second--

Signed and Sealed this

Twelfth Day of April, 1994

Bruce Lehman

*Attest:*

BRUCE LEHMAN

*Attesting Officer*

*Commissioner of Patents and Trademarks*